US006557265B2

(12) United States Patent
Coffin

(10) Patent No.: US 6,557,265 B2
(45) Date of Patent: May 6, 2003

(54) APPARATUS FOR RELEASABLY RETAINING A DISPOSABLE RAZOR CARTRIDGE

(75) Inventor: David C. Coffin, Hamden, CT (US)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 10/187,076

(22) Filed: Jun. 28, 2002

(65) Prior Publication Data

US 2003/0014871 A1 Jan. 23, 2003

Related U.S. Application Data

(63) Continuation of application No. 09/796,132, filed on Feb. 28, 2001, now abandoned.

(51) Int. Cl.[7] ..... B26B 21/52
(52) U.S. Cl. ..... 30/532; 30/527; 30/50
(58) Field of Search ..... 30/47, 526, 527, 30/532, 533, 50, 57

(56) References Cited

U.S. PATENT DOCUMENTS

| | | | | | |
|---|---|---|---|---|---|
| 3,795,979 | A | | 3/1974 | Perry | |
| 3,935,639 | A | | 2/1976 | Terry et al. | |
| 3,938,247 | A | | 2/1976 | Carbonell et al. | |
| 4,266,340 | A | | 5/1981 | Bowman | |
| 4,428,116 | A | * | 1/1984 | Chen et al. | 30/532 |
| 4,446,619 | A | * | 5/1984 | Jacobson | 30/526 |
| 4,514,904 | A | | 5/1985 | Bond | |
| 4,658,505 | A | | 4/1987 | Williams | |
| 4,791,724 | A | * | 12/1988 | Dumas | 30/526 |
| 4,903,405 | A | * | 2/1990 | Jalevy | 30/527 |
| 5,016,352 | A | | 5/1991 | Metcalf | |
| 5,497,551 | A | | 3/1996 | Apprille, Jr. | |
| 5,784,790 | A | | 7/1998 | Carson, III et al. | |
| 5,787,593 | A | * | 8/1998 | Althaus | 30/527 |
| 5,855,071 | A | | 1/1999 | Apprille, Jr. | |
| 5,890,296 | A | | 4/1999 | Metcalf | |
| 5,953,824 | A | | 9/1999 | Ferraro et al. | |
| 6,115,924 | A | * | 9/2000 | Oldroyd | 30/527 |
| 6,122,826 | A | * | 9/2000 | Coffin et al. | 30/527 |
| 6,138,361 | A | | 10/2000 | Richard et al. | |
| 6,311,400 | B1 | * | 11/2001 | Hawes et al. | 30/527 |

* cited by examiner

*Primary Examiner*—Hwei-Siu Payer
(74) *Attorney, Agent, or Firm*—McCormick, Paulding & Huber LLP

(57) ABSTRACT

In an apparatus for releasably retaining a disposable razor cartridge, a handle which includes an interior area defined by a housing section is provided. A cartridge retainer is at least partially positioned in the interior area and includes a substantially rigid web positioned within the interior area and pivotally coupled to the housing section. A pair of retaining arms are each spaced apart from the other and projecting in generally the same direction from the web. Each retaining arm includes a portion projecting outwardly from the housing section terminating in the cartridge engaging end for releasably retaining a disposable razor cartridge. A plastic hinge is integral with and extends between the pair of retaining arms so that upon exertion of a force thereon, in response to the disposable razor cartridge being pressed into a user's skin, the web section pivots within the housing section of the plastic hinge thereby forcing the retaining arms to move relative to each other and the disposable razor cartridge to pivot and follow the contours of a user's skin. Upon removal of the force, the plastic hinge provides the restoring moment to return the web and thereby the disposable razor cartridge to a neutral position.

10 Claims, 3 Drawing Sheets

APPARATUS FOR RELEASABLY RETAINING A DISPOSABLE RAZOR CARTRIDGE

This is a continuation of application Ser. No. 09/796,132 filed Feb. 28, 2001, now abandoned.

FIELD OF THE INVENTION

The present invention is generally related to razors used in shaving operations, and is more specifically directed to a razor handle incorporating a mechanism for releasably retaining a disposable razor cartridge.

BACKGROUND OF THE INVENTION

Modern non-disposable razors used for shaving usually include a disposable razor cartridge having one or more razor blades mounted thereon. Generally, these razors employ a handle incorporating a mechanism for retaining and when desired, releasing the disposable cartridge. Usually the disposable cartridge can pivot relative to the handle so that the blades incorporated thereon can follow the contours of the user's skin during a shaving operation.

Historically, the mechanisms incorporated into a razor handle to allow a disposable cartridge to be mounted thereon and releasable therefrom, as well as to allow the disposable cartridge to pivot have consisted of many interacting components. Since these components must fit into a small envelope provided at an end of the razor handle, they must be quite miniature. These miniature components tend to be expensive and somewhat difficult to assemble.

Based on the foregoing, it is the general object of the present invention to provide a disposable razor cartridge mounting mechanism that overcomes the problems and drawbacks of prior art mechanisms.

SUMMARY OF THE INVENTION

The present invention is directed in one aspect to an apparatus for releasably retaining a disposable razor cartridge that includes a razor handle having an interior area defined by a housing positioned at an end of the handle. A cartridge retainer is positioned in the interior of the housing and includes a first web section pivotally coupled to the housing and a second web section spaced away from the first web section and also pivotably coupled to the housing. A pair of retaining arms each spaced apart from the other project outwardly from the housing. Each retaining arm is coupled to the first and second web sections via first and second pair of plastic hinges extending between each of the first and second web sections and each retaining arm. Exertion of force on the pair of retaining arms such as would be caused by pushing a disposable razor cartridge mounted thereon into the skin of a user during a shaving operation causes the first and second pairs of plastic hinges to deform, and the first and second web sections to rotate. This in turn causes the disposable razor cartridge to pivot and follow the contours of the user's skin. Upon release of the force the plastic hinges provide a restoring force, urging the disposable razor cartridge back to a neutral position.

DETAILED DESCRIPTION OF THE PREFERRED EMBODIMENT

Figure 1:
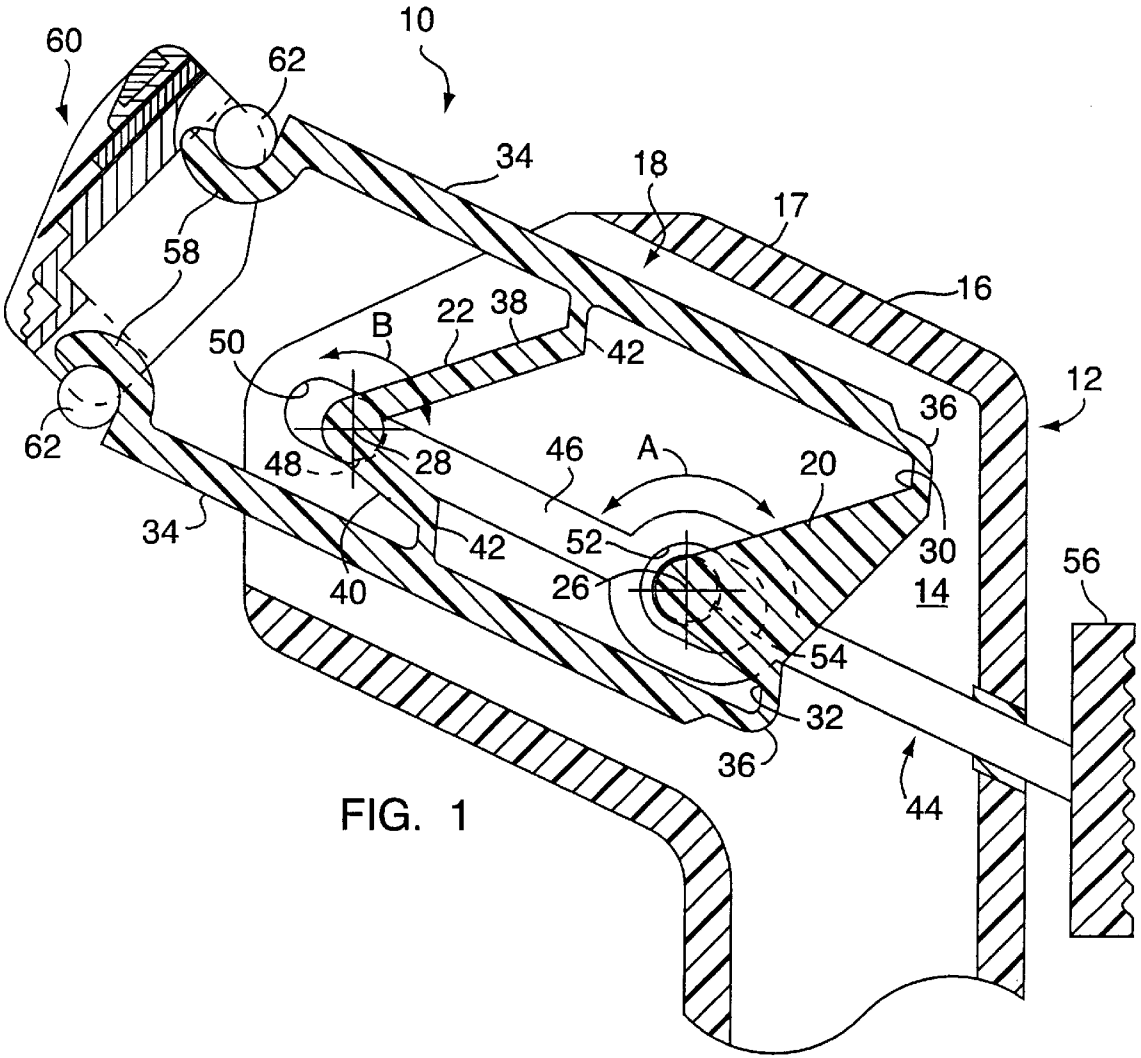
FIG. 1 is a partial cross-sectional, side elevational view of an embodiment of the apparatus of the present invention.

As shown in FIG. 1 a razor embodying the present invention is generally designated by the reference number 10 and includes a handle generally designated by the reference number 12. The handle 12 includes an interior area 14 defined by a housing 16, that in the illustrated embodiment is comprised of at least two housing sections 17 (only one shown). A cartridge retainer 18 is positioned within the interior area 14 and is adapted, as will be explained in detail hereinbelow, to releasably retain a disposable razor cartridge thereon. The cartridge retainer 18 includes, inter alia, an approximately rigid first web section 20 and a second web section 22. Each of the first and second web sections, 20 and 22 respectively, is pivotally mounted to the housing 16.

The first web section 20 is rotatable in the directions indicated by the arrows labeled "A", about a first pivot axis 26, and the second web section 22 is rotatable in the directions indicated by the arrows labeled "B" about a second pivot axis 28. In addition, the first web section 20 is triangular in shape defining first and second apexes, 30 and 32 respectively.

The cartridge retainer 18 also includes a pair of substantially rigid retaining arms 34, each spaced apart from the other and coupled to one of the first and second apexes, 30 and 32 respectively, defined by the first web section 20 via one of the pair of first plastic hinges 36. While a triangular shaped first web section has been shown and described, the present invention is not limited in this regard as other shaped web sections, such as rectangular, or round webs may be substituted without departing from the broader aspects of the present invention.

The second web section 22 includes two outwardly extending supports 38 and 40, one of which is coupled to each retaining arm 34 via one of the second pair of plastic hinges 42. As will be explained in detail below, during operation, and in response to forces transmitted through the retaining arms 34, the first plastic hinges 36 deform relative to the first web section 20, which also rotates about the first pivot axis 26 while the second plastic hinges 42 move relative to the second web section 22 which rotates about the second pivot axis 28.

Still referring to FIG. 1, the cartridge retainer 18 includes an actuator generally designated by the reference number 44 that includes a pair of actuating members 46 each extending from a first pivot axle 48 forming part of the second web section 22. Each first pivot axle is approximately coaxial with the second pivot axis 28 and is slidably positioned in opposing slots 50 (only one shown) in the housing 16. In addition, each actuating member 46 defines an elongated aperture 52 through which extend second pivot axles 54 that form part of the first web section 20. The second pivot axles 54 are each approximately coaxial with the first pivot axis 26. The actuating members 46 each project outwardly from the handle section 12 and are attached to a finger pad 56.

Still referring to FIG. 1, retaining arms 34 each extend outwardly from the housing 16 and terminate in a cartridge engaging end 58. Depending on the configuration of the disposable razor cartridge, generally designated by the reference number 60, the cartridge engaging ends 58 can assume different forms. For example, in the illustrated embodiment, the cartridge engaging ends 58 are in the form of cradles adapted to engage cylindrical mounting members 62 on the disposable razor cartridge 60. However, the present invention is not limited in this regard as the cartridge engaging ends could also take the form of tabs or protrusions adapted to engage complimentarily shaped apertures or recesses in the disposable razor cartridge. Preferably, the cartridge retainer is formed from a single piece of polymeric material, however, the present invention is not limited in this regard, as multiple components, and other material such as metals can be substituted. In addition the cartridge retainer and actuator can be formed from different materials with the cartridge retainer and actuator being formed into a single piece or multiple pieces.

Figure 2:
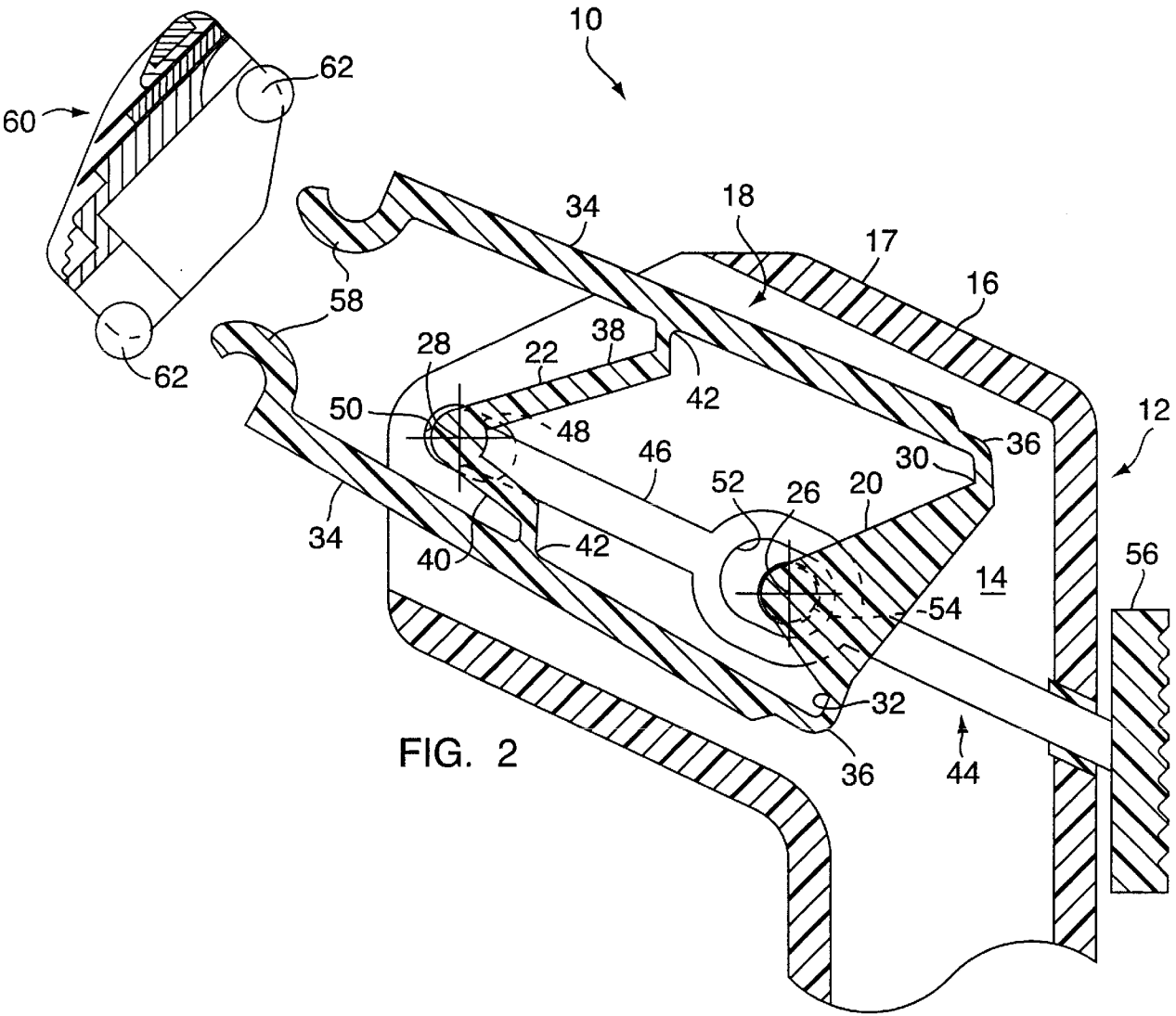
FIG. 2 is a partial cross-sectional side elevational view of the apparatus of FIG. 1, showing the cartridge retainer of FIG. 1 in a cartridge releasing position.

As shown in FIG. 2, to change disposable razor cartridges 10, the actuator 44 is manually manipulated by pushing the finger pad 56 towards the handle section 12. This causes the actuating members 46 to move the first pivot axles 48 within the slots 50 toward the disposable razor cartridge 60. This in turn causes the first and second plastic hinges 36 and 42 to deform thereby allowing the retaining arms 34 to move toward one another such that the retaining arms assume a cartridge releasing position and disengage the disposable razor cartridge 60.

Figure 3:
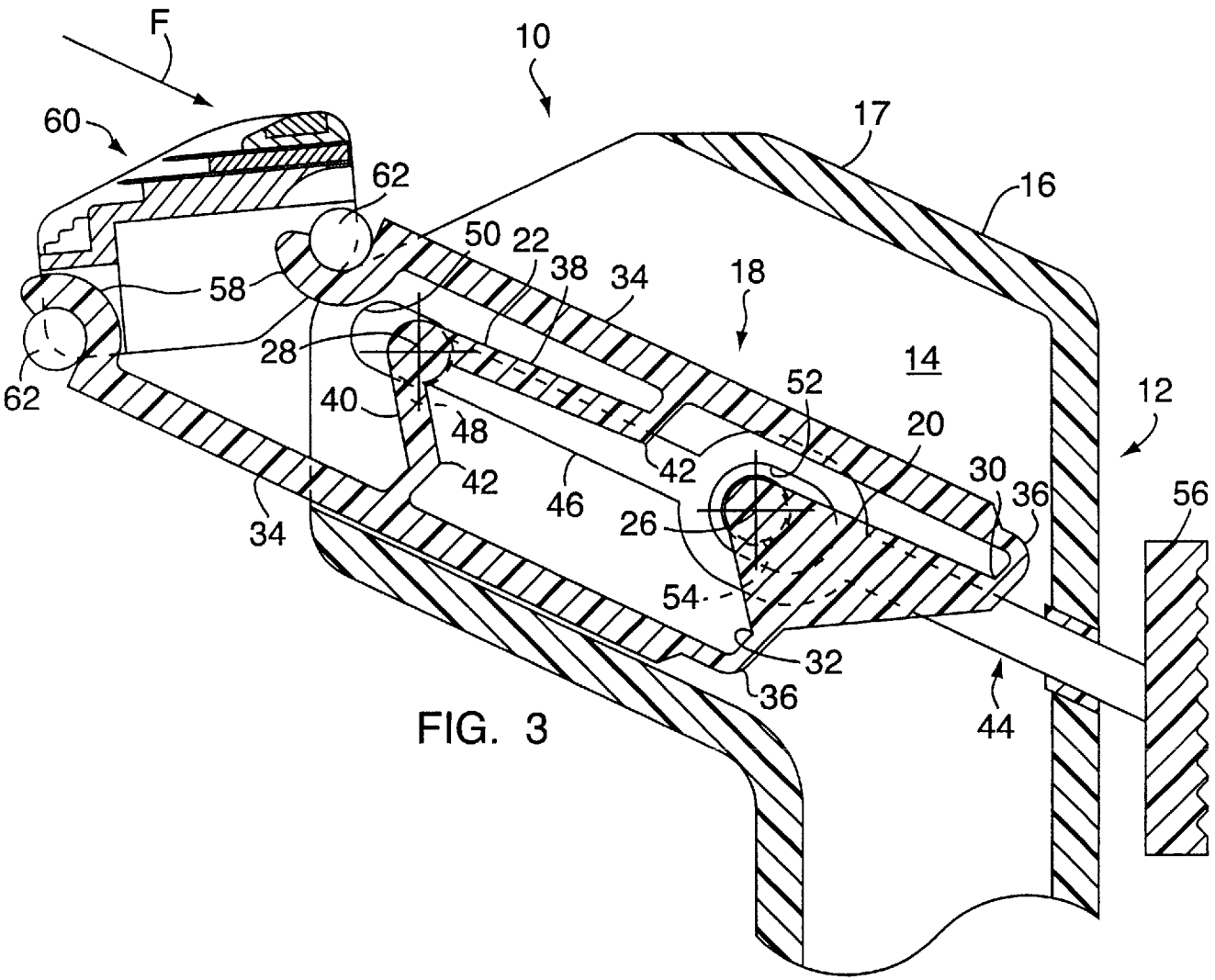
FIG. 3 is a partial cross-sectional side elevational view of the apparatus of FIG. 1, showing the cartridge retainer of FIG. 1 in a pivoted position.

Turning to FIG. 3, the cartridge retainer 18 also allows the disposable razor cartridge 60 to pivot in response to a force exerted thereon, such as is encountered during a shaving operation when a user presses the disposable razor cartridge to his/her skin in an effort to cause the cartridge to follow the skin's contours. As the cartridge 60 is drawn across the skin, the forces exerted on the cartridge will cause the cartridge to pivot in the direction of largest force. For Example, in FIG. 3 the pivoting force is characterized by the arrow labeled "F". The force "F" causes the first and second plastic hinges, 36 and 42 respectively, to deform which in turn causes the first and second web sections, 20 and 22 respectively, to pivot about the pivot axes 26 and 28 thereby allowing the disposable razor cartridge 60 to also pivot. Upon removal of the force "F", the plastic hinges, 36 and 42, exert restoring forces that urge the disposable razor cartridge 60 to the neutral or unpivoted position.

While preferred embodiments have been shown and described, Various modifications and substitutions may be made without departing from the spirit and scope of the invention. Accordingly, it is to be understood that the present invention has been described by way of example, and not by limitation.

What is claimed is:

1. An apparatus for releasably retaining a disposable razor cartridge comprising:

a razor handle, a portion of which includes an interior area defined by a housing;

a cartridge retainer at least partially positioned in said interior area said cartridge retainer including:

a first web section positioned within said interior area and pivotably coupled to said housing;

a second web section positioned away from said first web section and rotatably coupled to said housing;

a pair of retaining arms projecting outwardly from said housing, each defining a cartridge engaging end;

each of said retaining arms being coupled to said first web section by a first pair of plastic hinges each interposed between said first web section and one of said retaining arms and by a second pair of plastic hinges each interposed between said second web section and one of said retaining arms.

2. An apparatus for releasably retaining a disposable razor cartridge as defined by claim 1, further comprising:

a manual actuator coupled to said cartridge retainer and movable between cartridge retaining positions and a cartridge releasing position to allow a user to engage or disengage said disposable razor cartridge.

3. An apparatus for releasably retaining a disposable razor cartridge as defined by claim 2 wherein said manual actuator and said cartridge retainer are formed from a single piece.

4. An apparatus for releasably retaining a disposable razor cartridge as defined by claim 3 wherein said actuator and said cartridge retainer are formed from a polymeric material.

5. An apparatus for releasably retaining a disposable razor cartridge as defined by claim 2 wherein said cartridge retainer is made from a first material and said actuator is made from a second material.

6. An apparatus for releasably retaining a disposable razor cartridge as defined by claim 5 wherein said first and second materials are each polymeric.

7. An apparatus for releasably retaining a disposable razor cartridge as defined by claim 1, wherein said first web section is triangular and defines a pair of opposing apexes, one of said first pair of plastic hinges extending from each of said apexes.

8. An apparatus for releasably retaining a disposable razor cartridge as defined by claim 1, wherein:

said second web section defines a pair of first pivot axles extending outwardly therefrom and approximately coaxial with one another; and wherein;

said housing defines a pair of opposing slots each adapted to slidingly receive one of said pivot axles.

9. An apparatus for releasably retaining a disposable razor cartridge as defined by claim 8, further comprising:

a manual actuator including a pair of actuating members each extending from one of said pivot axles and having a portion that extends through said housing;

said actuating members being coupled to a finger pad adjacent to said handle to allow a user to manipulate said actuator between cartridge retaining positions and a cartridge releasing position.

10. An apparatus for releasably retaining a disposable razor cartridge as defined by claim 1, wherein said cartridge engaging ends of said arms each define a cradle adapted to engage a complementarily shaped portion of said disposable razor cartridge, thereby releasably retaining said razor cartridge on said handle.

* * * * *